US009371741B2

(12) United States Patent
Ito

(10) Patent No.: US 9,371,741 B2
(45) Date of Patent: Jun. 21, 2016

(54) TURBINE BLADE AND GAS TURBINE HAVING THE SAME

(71) Applicant: MITSUBISHI HEAVY INDUSTRIES, LTD., Tokyo (JP)

(72) Inventor: Ryuta Ito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 537 days.

(21) Appl. No.: 13/660,431

(22) Filed: Oct. 25, 2012

(65) Prior Publication Data

US 2013/0142667 A1 Jun. 6, 2013

(30) Foreign Application Priority Data

Oct. 27, 2011 (JP) ..... 2011-236148

(51) Int. Cl.
*F01D 5/22* (2006.01)
*F01D 25/12* (2006.01)
*F01D 5/18* (2006.01)

(52) U.S. Cl.
CPC ..... *F01D 25/12* (2013.01); *F01D 5/187* (2013.01); *F01D 5/225* (2013.01); *F05D 2260/202* (2013.01)

(58) Field of Classification Search
CPC ..... F01D 5/225; F01D 5/181; F01D 5/18; F01D 5/22; F01D 11/08
USPC ..... 416/92, 192; 415/173.6
See application file for complete search history.

(56) References Cited

U.S. PATENT DOCUMENTS

| | | | | |
|---|---|---|---|---|
| 3,989,412 | A | 11/1976 | Mukherjee | |
| 4,019,831 | A | 4/1977 | Franklin et al. | |
| 4,073,599 | A * | 2/1978 | Allen et al. | 416/97 R |
| 6,761,534 | B1 | 7/2004 | Willett | |
| 2005/0042075 | A1 | 2/2005 | Yang et al. | |
| 2010/0024216 | A1 | 2/2010 | DeSander et al. | |

FOREIGN PATENT DOCUMENTS

| | | | |
|---|---|---|---|
| CN | 101063411 | A | 10/2007 |
| CN | 101482030 | A | 7/2009 |

(Continued)

OTHER PUBLICATIONS

Chinese Office Action dated Dec. 2, 2014, issued in Chinese Patent Application No. 201280036830.9, w/partial English translation (10 pages).

(Continued)

*Primary Examiner* — Richard Edgar
(74) *Attorney, Agent, or Firm* — Westerman, Hattori, Daniels & Adrian, LLP

(57) ABSTRACT

A turbine blade of the present invention includes a blade body mounted on a rotor body so as to extend outward from the rotor body in a radial direction of the rotor body and a chip shroud fixed to the outside of the blade body in the radial direction. A cooling passage which extends in the radial direction of the rotor body and in which a cooling medium circulates is formed in the blade body. The chip shroud includes a shroud body where a recess opened to the outside in the radial direction and communicating with the cooling passage is formed on an outer peripheral end face, and a plug that includes a plurality of plug pieces closing an opening of the recess in cooperation with each other by being inserted into mounting grooves formed on side surfaces of the recess.

9 Claims, 9 Drawing Sheets

(56) References Cited

FOREIGN PATENT DOCUMENTS

| | | | | |
|---|---|---|---|---|
| JP | 03194101 | A | * | 8/1991 |
| JP | 11-200804 | A | | 7/1999 |
| JP | 11-223103 | A | | 8/1999 |
| JP | 2000-291405 | A | | 10/2000 |
| JP | 2000-297604 | A | | 10/2000 |
| JP | 2003-65068 | A | | 3/2003 |
| JP | 2010-031865 | A | | 2/2010 |
| WO | 00/08307 | A1 | | 2/2000 |

OTHER PUBLICATIONS

International Search Report of PCT/JP2012/077455, mailing date Jan. 15, 2013.

Written Opinion of PCT/JP2012/077455, mailing date Jan. 15, 2013.

Office Action dated Jul. 17, 2015, issued in counterpart Korean Patent Application No. 10-2014-7000124, with English translation (3 pages).

* cited by examiner

TURBINE BLADE AND GAS TURBINE HAVING THE SAME

TECHNICAL FIELD

The present invention relates to a turbine blade and a gas turbine including the turbine blades.

Priority is claimed to Japanese Patent Application No. 2011-236148, filed Oct. 27, 2011, the entire content of which is incorporated herein by reference.

BACKGROUND ART

The temperature and efficiency of a gas turbine have become high in recent years, and according to this a turbine blade also tends to increase in height (become longer and larger). In particular, since thermal energy of a combustion gas to be exhausted needs to be suppressed in a turbine blade of the rear stage, the height of the blade is significantly increased. Since the number of vibrations is reduced with the increase of the height of a blade in such a turbine blade, the possibility that an unstable vibration mode such as flutter occurs is increased.

Therefore, a tip shroud is disposed at the tip of a blade body of each turbine blade to increase structural damping, so that the occurrence of the unstable vibration mode is suppressed. Since the tip shroud also needs to be cooled as the temperature of the gas turbine becomes high, a cooling system is formed in the tip shroud.

An example of such a cooling system is disclosed in Patent Document 1, where a cavity communicating with cooling passages in the blade body is formed in the tip shroud so that cooling air having cooled the blade body can be used to cool the tip shroud. This cavity is formed by forming a recess which communicates with the cooling passages in the tip shroud and closing an opening of the recess with a plug. Accordingly, cooling air is introduced into the cavity and a cooling medium is supplied to the outer periphery of the tip shroud via the cavity, so that the tip shroud is cooled.

Furthermore, Patent Document 2 discloses a technique where a mounting groove is formed on each of a pair of side surfaces of the recess and the cavity is formed by closing an opening of the recess by insertion of the plug into the mounting grooves in order to prevent the plug from coming off due to a centrifugal force generated by the rotation of a rotor. More specifically, the mounting grooves of Patent Document 2 are formed so as to face each other in the axial direction of the rotor, and the opening is closed when one plug is inserted into the mounting grooves in the circumferential direction.

PRIOR ART DOCUMENT

Patent Document

Patent Document 1: Japanese Unexamined Patent Application, First Publication No. 2000-297604

Patent Document 2: Japanese Unexamined Patent Application, First Publication No. 2010-31865

DISCLOSURE OF THE INVENTION

Problem that the Invention is to Solve

However, the technique of Patent Document 2 has a problem in that a portion of the plug which is not inserted into the mounting grooves swells to the outside in the radial direction of the rotor by a centrifugal force. That is, since the pair of mounting grooves face each other in the axial direction of the rotor and these mounting grooves are separated from each other to some extent, the middle portion of the plug is easily subjected to creep deformation outwards in the radial direction by a centrifugal force applied to the plug or a pressure difference between the inside and outside of the cavity. Accordingly, there is a concern that the durability of the plug is reduced by the swelling of the plug itself due to the creep deformation when the plug is used for a long period of time.

The present invention has been made in consideration of these problems, and an object of the invention is to provide a turbine blade that can improve the durability of a plug and a gas turbine including the turbine blades.

Means for Solving the Problem (1) A turbine blade according to the present invention includes a blade body that is mounted on a rotor body so as to extend outward from the rotor body in a radial direction of the rotor body, and a tip shroud that is fixed to the outside of the blade body in the radial direction. A cooling passage which extends in the radial direction of the rotor body and in which a cooling medium circulates is formed in the blade body. The tip shroud includes a shroud body where a recess opened to the outside in the radial direction and communicating with the cooling passage is formed on an outer peripheral end face, and a plug that includes a plurality of plug pieces closing an opening of the recess in cooperation with each other by being inserted into mounting grooves formed on side surfaces of the recess.

According to the turbine blade having these characteristics, the plug is formed of the plurality of plug pieces and each of the plug pieces is inserted into the mounting grooves. Accordingly, it is possible to reduce swelling as compared to a case where the plug is formed of a single body.

(2) It is preferable that the recess extends in a direction along the outer peripheral end face as a longitudinal direction thereof, the mounting grooves is formed on the pair of side surfaces along the longitudinal direction, and the plurality of plug pieces close the opening of the recess by lining up in the longitudinal direction so as to come into contact with each other.

Since the mounting grooves are formed on the pair of side surfaces of the recess along the longitudinal direction in this case, a direction where the pair of side surfaces face each other is the lateral direction of the recess. Accordingly, an interval between the pair of mounting grooves is set to be smaller than that in the case where the mounting grooves are formed on the side surfaces of the recess along the lateral direction. Therefore, since it is also possible to set an interval which is formed between the mounting grooves at the plug pieces inserted into the mounting grooves in the direction where the side surfaces face each other to be small, it is possible to reduce the deformation of the plug pieces caused by a centrifugal force and to further reduce the swelling of the plug pieces.

(3) It is preferable that a plurality of the cooling passages are formed in the blade body, outer end portions of the plurality of cooling passages in the radial direction are arranged in a direction that is inclined in a circumferential direction of the rotor body and an axial direction of the rotor body, and the recess extends in an arrangement direction of the outer end portions of the plurality of cooling passages in the radial direction as the longitudinal direction thereof.

In this case, the longitudinal direction of the recess extends in the direction inclined in the circumferential direction and the axial direction. Accordingly, for example, even if obstacles are present when the plug pieces are inserted into the outer peripheral end face of the tip shroud, it is possible to easily insert the plug pieces into the mounting grooves. Further, it is possible to prevent the plug pieces from coming off due to the rotational acceleration of the rotor.

(4) It is preferable that the shroud body includes a plug insertion port for inserting the plug pieces into the mounting grooves on at least one end of the recess in the longitudinal direction.

In this case, it is possible to easily and reliably insert the plug pieces into the mounting grooves.

(5) It is preferable that the shroud body includes a plurality of chip fins that protrude from the outer peripheral end face, extend in the circumferential direction of the rotor body, and are disposed at intervals in the axial direction of the rotor body, and the recess is formed between the plurality of chip fins.

In this case, since the plug is formed of the plurality of plug pieces, even if the plurality of chip fins are formed on the outer peripheral end face of the shroud body, the chip fins are unlikely to become obstacles and it is possible to easily insert these plug pieces into the mounting grooves.

Further, when the recess is formed so as to be inclined in the circumferential direction and the axial direction as described above, it is possible to more easily insert the plug pieces into the mounting grooves, even if the chip fins are present.

(6) A gas turbine according to the present invention includes the rotor body on which any of the above-mentioned turbine blades are mounted and a casing that rotatably covers the rotor body.

Since the gas turbine having these characteristics includes the above-mentioned turbine blades, it is possible to reduce the swelling of the plug.

Advantage of the Invention

According to the turbine blade and the gas turbine of the present invention, since the plug is divided into the respective plug pieces, it is possible to reduce swelling due to a centrifugal force. Accordingly, it is possible to improve the durability of the plug.

BEST MODE FOR CARRYING OUT THE INVENTION

An embodiment of the present invention will be described below with reference to the drawings.

Figure 1:
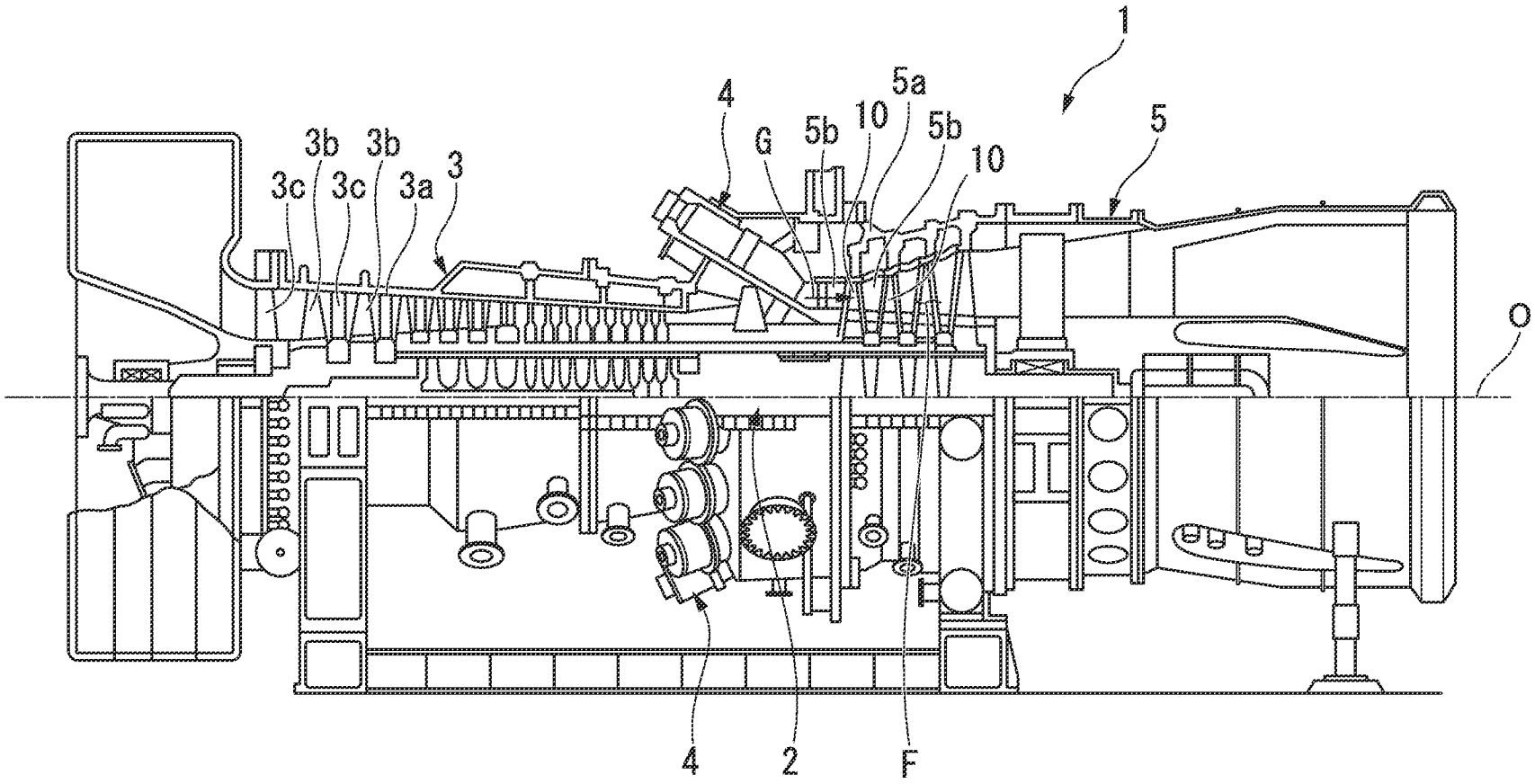
FIG. 1 is an overall view of a gas turbine according to an embodiment of the present invention.

As shown in FIG. 1, a gas turbine 1 includes a compressor 3 that generates compressed air, a combustor 4 that generates a combustion gas G by adding a fuel to the compressed air supplied from the compressor 3, and a turbine 5 that is rotationally driven by the combustion gas G supplied from the combustor 4.

The compressor 3 includes a compressor casing 3*a* that rotatably covers a rotor body 2, a plurality of compressor blades 3*b* that are fixed to the rotor body 2 and arranged in an annular shape, and a plurality of compressor vanes 3*c* that are supported by the compressor casing 3*a* and arranged in an annular shape. The compressor blades 3*b* and the compressor vanes 3*c* are alternately disposed in a plurality of stages in an axis O direction of a rotor.

Further, the turbine 5 includes a turbine casing 5*a* which rotatably covers the rotor body 2 and in which a combustion gas flow passage F is formed, a plurality of turbine blades 10 that are fixed to the rotor body 2 and arranged in an annular shape, and a plurality of turbine vanes 5*b* that are supported by the turbine casing 5*a* and arranged in an annular shape. The turbine blades 10 and the turbine vanes 5*b* are alternately disposed in a plurality of stages in the axis O direction of the rotor body 2.

In the following description, the radial direction of the rotor body 2 is simply referred to as the "radial direction", the circumferential direction of the rotor body 2 is simply referred to as the "circumferential direction", and the axis O direction of the rotor body 2 is simply referred to as the "axis O direction".

Next, the details of the turbine blades 10 will be described with reference to the drawings.

Figure 2:
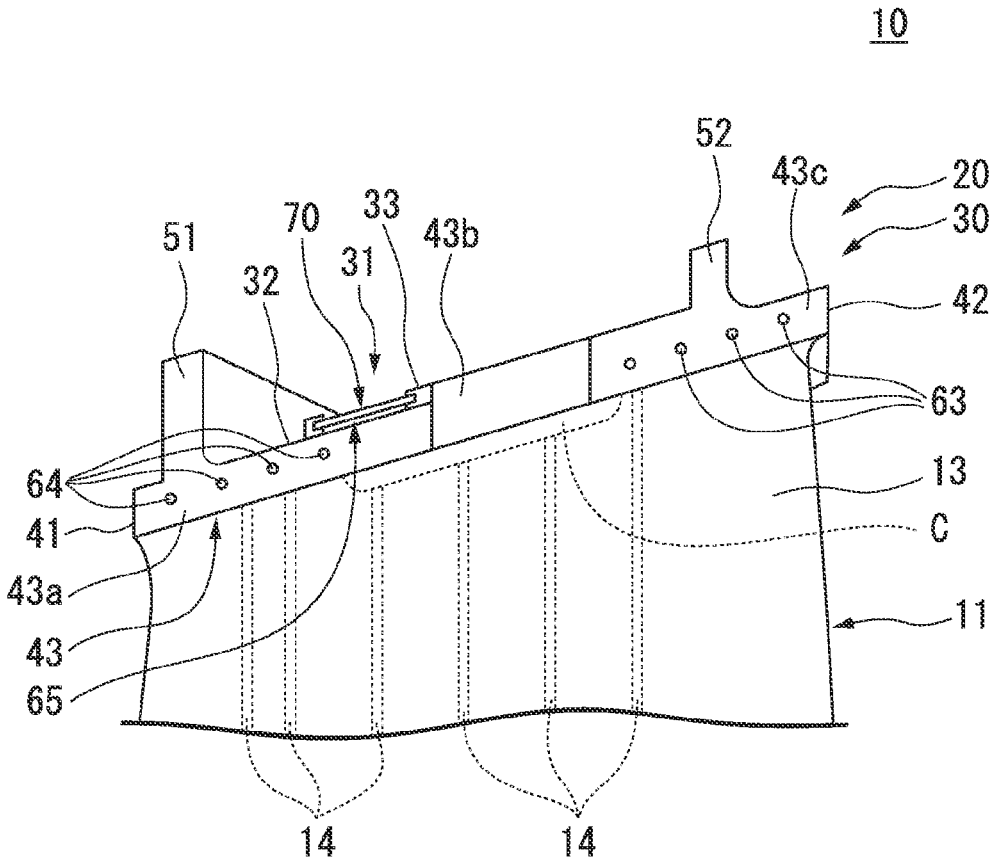
FIG. 2 is a view of a turbine blade of the gas turbine according to the embodiment of the present invention when seen in the circumferential direction of a rotor.

As shown in FIG. 2, the turbine blade 10 includes a blade body 11 that is disposed in a combustion gas flow passage F of FIG. 1, and a tip shroud 20 that is fixed to the outside of the blade body 11 in the radial direction. Although not shown, a platform that extends from the blade body 11 and a blade root that further protrudes inward from the platform in the radial direction are provided on the inside of the blade body 11 in the radial direction. The blade root is mounted on the outer peripheral surface of the rotor body 2, so that the turbine blade 10 is integrally fixed to the rotor body 2.

Figure 3:
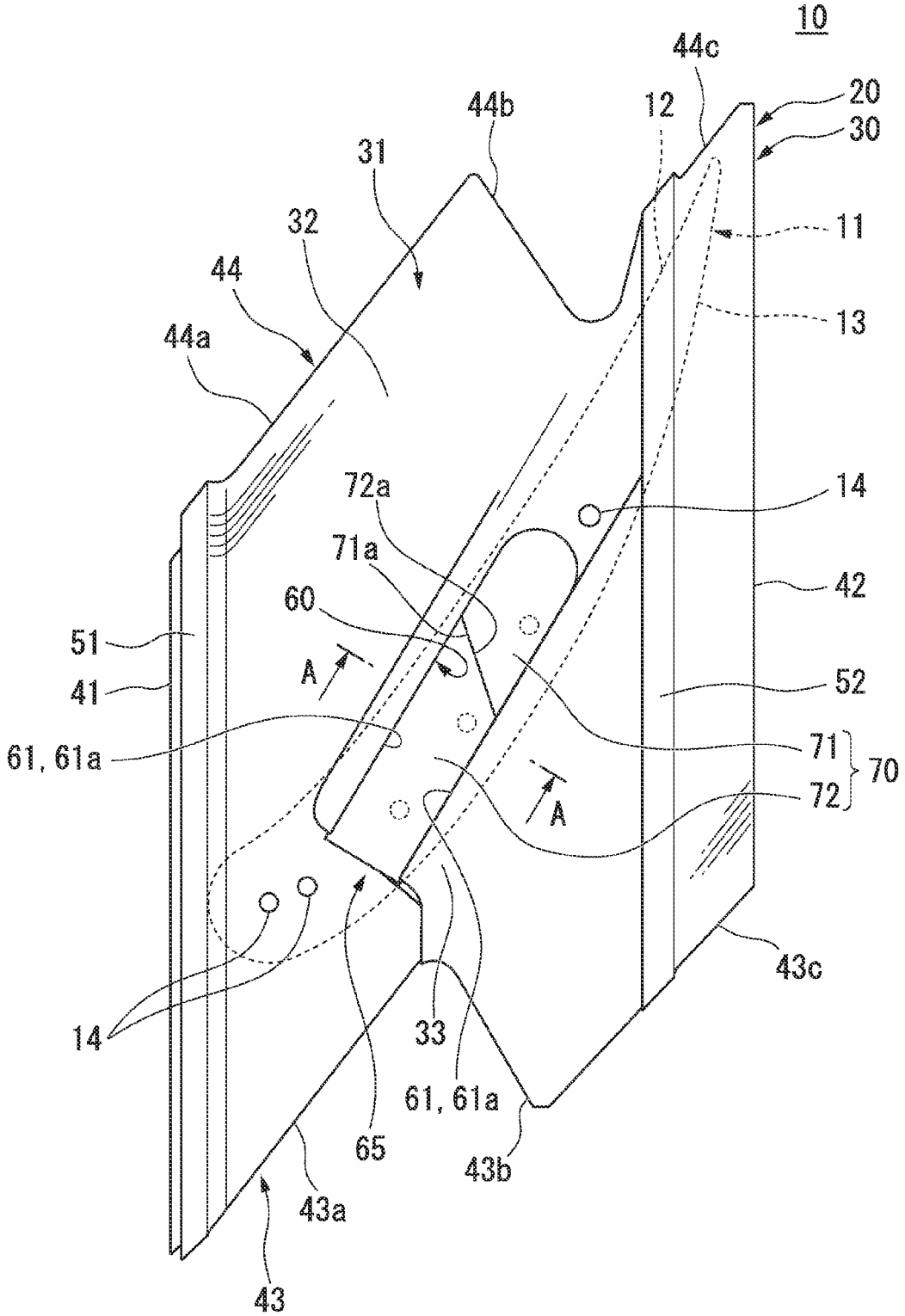
FIG. 3 is a view of the turbine blade of the gas turbine according to the embodiment of the present invention when seen from the outside in the radial direction of the rotor.

As shown in FIG. 2, the blade body 11 is provided to extend from the rotor body 2 toward the outside of the rotor body 2 in the radial direction. As shown in FIG. 3, the blade body 11 has a cross section of an aerofoil shape formed with a pressure side 12 and a suction side 13 so as to be projectingly curved toward one side in the circumferential direction (the front side in a rotation direction of the rotor body 2, that is, the lower side in FIGS. 3 and 4) from the leading edge which is the upstream side of the combustion gas flow passage to the trailing edge which is the downstream side of the combustion gas flow passage along the axis O direction. Specifically, the cross-sectional shape is an aerofoil shape which is inclined toward the other side in the circumferential direction (the rear side in the rotation direction of the rotor body 2, that is, the upper side in FIGS. 3 and 4) as it extends to the other side in the axis O direction (the downstream side of the gas flow passage, that is, the right side in FIGS. 2 to 4).

Furthermore, a curve connecting points at the same distance from the pressure side 12 and the suction side 13 on the cross-section orthogonal to the extending direction of the blade body 11 from the leading edge to the trailing edge form a center line. The center line is curved like the curved shape of the blade body 11.

In addition, a plurality of (6 in this embodiment) cooling passages 14 extending in the radial direction are formed in the blade body 11 as shown in FIG. 2. The cooling passages 14 are, for example, formed at intervals so as to be arranged in the direction along the center line, that is, the extending direction of the cross-sectional shape of the blade body 11. Cooling air (cooling medium) supplied from the inside of the blade body 11 in the radial direction circulates in the cooling passages 14 toward the outside in the radial direction.

The tip shroud 20 includes a shroud body 30 that is provided integrally with the blade body 11 and a plug 70 that is detachably mounted on the shroud body 30.

Figure 4:
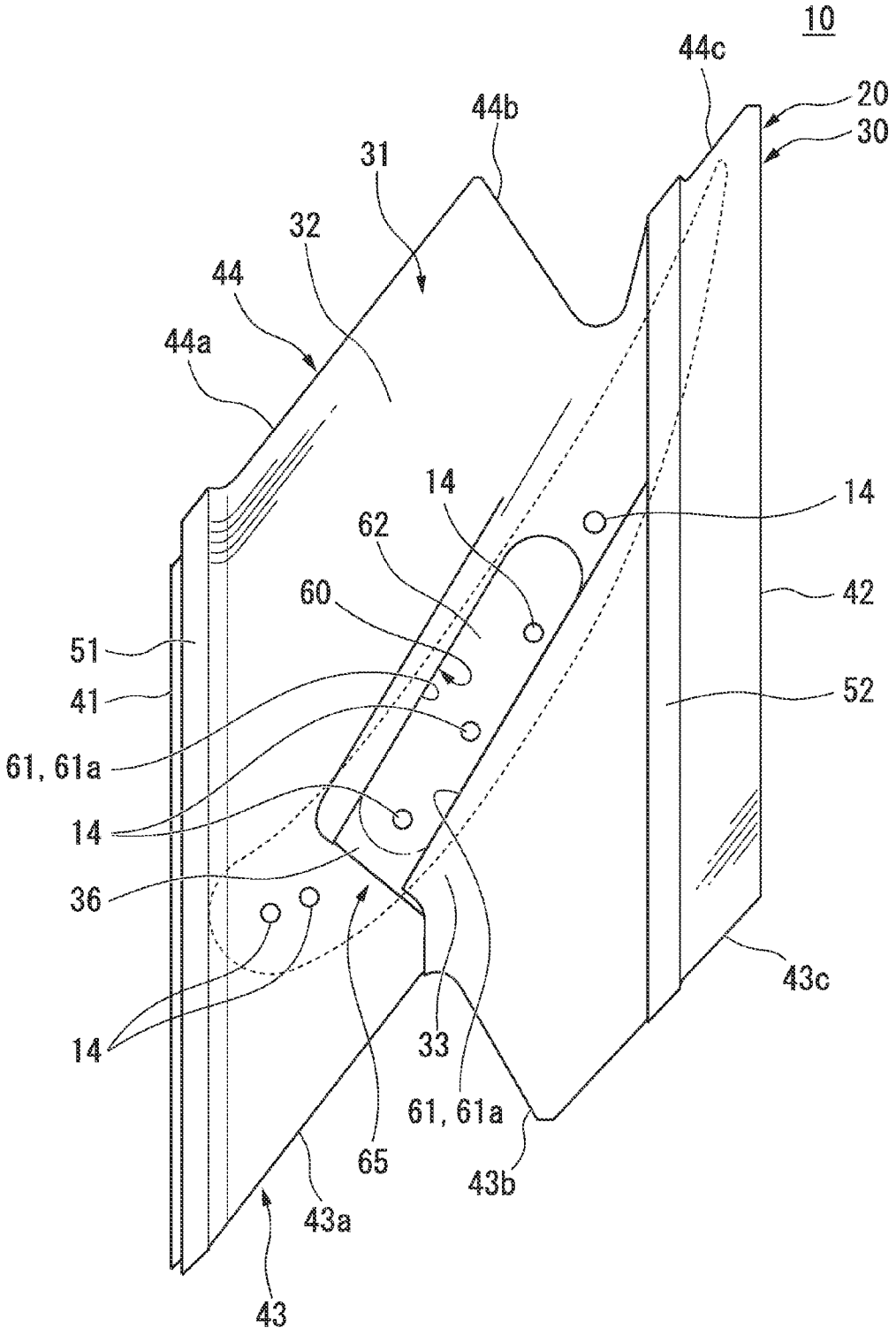
FIG. 4 is a view of a shroud body when seen from the outside in the radial direction of the rotor.

As shown in FIGS. 2 to 4, the shroud body 30 is formed in the shape of a plate having a predetermined thickness in the radial direction and is integrally fixed to the blade body 11 so as to extend in the circumferential direction on the outside of the blade body 11 in the radial direction. A surface of the shroud body 30 facing the outside in the radial direction forms an outer peripheral end face 31 of the shroud body 30.

An upstream-side end face 41 of the shroud body 30 faces one side in the axis O direction which is the upstream side (the upstream side of the gas flow passage, that is, the left side in FIGS. 2 to 4), and extends in the circumferential direction. A downstream-side end face 42 of the shroud body 30 faces the other side in the axis O direction which is the downstream side and extends in the circumferential direction. The upstream-side end face 41 and the downstream-side end face 42 are parallel to each other.

As shown in FIGS. 3 and 4, a first contact surface 43 of the tip shroud 20 faces the one side in the circumferential direction, and a second contact surface 44 of the tip shroud 20 faces the other side in the circumferential direction.

The first contact surface 43 is formed of three surfaces, that is, a first inclined surface 43*a*, a second inclined surface 43*b*, and a third inclined surface 43*c*.

The first inclined surface 43*a* is connected to the one side in the circumferential direction of the upstream-side end face 41, and is inclined toward the other side in the circumferential direction as it extends to the other side in the axis O direction. The second inclined surface 43*b* is connected to the other side in the axis O direction of the first inclined surface 43*a*, and is inclined toward the one side in the circumferential direction as it extends to the other side in the axis O direction. The third inclined surface 43*c* is connected to the other side in the axis O direction of the second inclined surface 43*b*, is inclined toward the other side in the circumferential direction as it extends to the other side in the axis O direction, and is connected to the one side in the circumferential direction of the downstream-side end face 42.

The second contact surface 44 is formed of three surfaces, that is, a fourth inclined surface 44*a*, a fifth inclined surface 44*b*, and a sixth inclined surface 44*c*.

The fourth inclined surface 44*a* is connected to the other side in the circumferential direction of the upstream-side end face 41, and extends parallel to the first inclined surface 43*a*. The fifth inclined surface 44*b* is connected to the other side in the axis O direction of the fourth inclined surface 44*a*, and extends parallel to the second inclined surface 43*b*. The sixth inclined surface 44*c* is connected to the other side in the axis O direction of the fifth inclined surface 44*b*, extends parallel to the third inclined surface 43*c*, and is connected to the other side in the circumferential direction of the downstream-side end face 42.

A connection portion between the first inclined surface 43*a* and the second inclined surface 43*b* is positioned closer to the one side in the axis O direction than a connection portion between the fourth inclined surface 44*a* and the fifth inclined surfaces 44*b*. Further, a connection portion between the second inclined surface 43*b* and the third inclined surface 43*c* is positioned closer to the one end in the axis O direction than a connection portion between the fifth inclined surface 44*b* and the sixth inclined surface 44*c*.

When each of the turbine blades 10 is mounted on the rotor body 2, the second inclined surface 43*b* of the first contact surface 43 of the shroud body 30 comes into sliding contact with the fifth inclined surface 44*b* of the second contact surface 44 of the adjacent tip shroud 20. Accordingly, an annular ring is formed by a plurality of tip shrouds 20.

The outer peripheral end face 31 of the shroud body 30 is formed in a Z shape by the upstream-side end face 41, the downstream-side end face 42, the first contact surface 43, and the second contact surface 44, which have been described above, when seen from the outside in the radial direction.

As shown in FIGS. 2 to 4, a first chip fin 51, a second chip fin 52, and a recess 60 are formed on the outer peripheral end face 31 of the shroud body 30.

The first chip fin 51 is provided on a portion of the outer peripheral end face 31 that is close to the one side in the axis O direction, protrudes outward from the outer peripheral end face 31 in the radial direction, and extends parallel to the upstream-side end face 41 over the entire portion of the outer peripheral end face 31 in the circumferential direction. Both ends of the first chip fin 51 in the circumferential direction are connected to the first inclined surface 43*a* and the fourth inclined surface 44*a*, respectively.

Further, the second chip fin 52 is provided on a portion of the outer peripheral end face 31 that is close to the other side in the axis O direction, protrudes outward from the outer peripheral end face 31 in the radial direction like the first chip fin 51, and extends parallel to the downstream-side end face 42 over the entire portion of the outer peripheral end face 31 in the circumferential direction. Both ends of the second chip fin 52 in the circumferential direction are connected to the third inclined surface 43*c* and the sixth inclined surface 44*c*, respectively.

In this way, the first chip fin 51 and the second chip fin 52 are provided so as to be separated from each other in the axis O direction and parallel to each other. Sealing performance between the turbine blade 10 and the turbine casing is secured by the first chip fin 51 and the second chip fin 52.

The recess 60 is formed between the first chip fin 51 and the second chip fin 52 on the outer peripheral end face 31 so as to be dented inward from the outer peripheral end face 31 in the radial direction, and is opened to the outside in the radial direction. The recess 60 extends in a direction along the outer peripheral end face 31 as a longitudinal direction thereof. In this embodiment, the recess 60 extends in a direction which is inclined toward the other side in the circumferential direction as it extends to the other side in the axis O direction. That is, similar to the extending direction of the cross-sectional shape of the blade body 11, the recess 60 extends in a direction inclined in the circumferential direction and the axis O direction of the rotor body 2 as the longitudinal direction thereof. Both edge portions of the recess 60 in the longitudinal direction are formed in circular arc shapes, and both edge portions of the recess 60 in the lateral direction are formed in linear shapes extending parallel to each other in the longitudinal direction.

Figure 5:
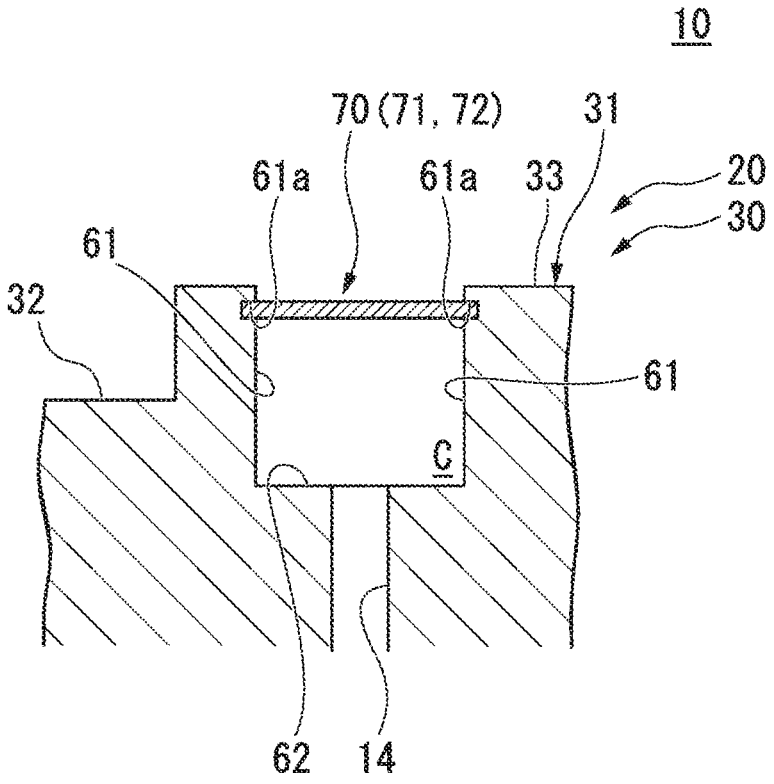
FIG. 5 is a cross-sectional view taken along line A-A of FIG. 3.

Further, as shown in FIGS. 2, 4, and 5, outer end portions of a part of the plurality of cooling passages 14 (three of the six cooling passages 14 in this embodiment) in the radial direction are opened to a bottom 62 of the recess 60. Accordingly, the recess 60 and the part of the cooling passages 14 are in communication with each other.

That is, the outer end portions of the plurality of cooling passages 14 in the radial direction are arranged in a direction inclined in the circumferential direction and the axis O direction of the rotor body 2 so as to correspond to the extending direction of the cross-sectional shape of the blade body 11. Further, since the recess 60 is formed to extend in the arrangement direction of the end portions of the cooling passages 14 as the longitudinal direction thereof, the end portions of the part of cooling passages 14 are opened into the recess 60.

Furthermore, a plurality of cooling holes 63 (see FIG. 2) which make the recess 60 communicate with the third inclined surface 43*c* of the first contact surface 43, and a plurality of cooling holes 63 (not shown) which make the recess 60 communicate with the fourth inclined surface 44*a* of the second contact surface 44 are formed in the shroud body 30. In addition, a plurality of cooling holes 64 which make the recess 60 communicate with the first inclined surface 43*a* of the first contact surface 43 are formed in the shroud body 30. The openings of these cooling holes 63 and 64 on the third inclined surface 43*c*, the fourth inclined surface 44*a*, and the first inclined surface 43*a* are arranged in the extending direction of the third inclined surface 43*c*, the fourth inclined surface 44*a*, and the first inclined surface 43*a*.

A first main surface 32 is an area of the outer peripheral end face 31 which is connected to the first inclined surface 43*a* and the fourth inclined surface 44*a* and positioned closer to the other end in the axis O direction than the first chip fin 51.

A portion of a front side in the longitudinal direction (one end side in the longitudinal direction, that is, the one side in the axis O direction and the one side in the circumferential direction) of the recess 60 on the outer peripheral end face 31 forms an insertion surface 36 which is raised outwardly in a flat shape from the first main surface 32 in the radial direction.

An area of the outer peripheral end face 31 which includes the edge portions of the recess 60 expect for the front side in the longitudinal direction forms a second main surface 33 which is raised from the first main surface 32 and the insertion surface 36 in the outwardly radial direction so as to surround the recess 60 from both sides in the lateral direction and a rear side in the longitudinal direction (the other side in the axis O direction and the other side in the circumferential direction). Accordingly, the recess 60 is formed so as to be dented inward from the second main surface 33 of the outer peripheral end face 31 in the radial direction. Further, the front side of the recess 60 in the longitudinal direction is opened to the insertion surface 36.

A part of the plurality of cooling passages 14 (two of the six cooling passages 14 in this embodiment) is opened to the first main surface 32 of the outer peripheral end face 31. Further, a part of the plurality of cooling passages 14 (one of the six cooling passages 14 in this embodiment) is opened to the rear side of the recess 60 on the second main surface 33 of the outer peripheral end face 31 in the longitudinal direction.

Further, as shown in FIG. 5, mounting grooves 61*a* extending in the longitudinal direction are formed on a pair of side surfaces 61 of the recess 60 that are along the longitudinal direction of the recess, that is, a pair of side surfaces 61 of the recess 60 facing each other in the lateral direction. The mounting grooves 61*a* are grooves that are dented so as to be recessed from the pair of side surfaces 61 in a rectangular shape, and extend over the entire length of the recess 60 in the longitudinal direction.

The positions of the mounting grooves 61*a* in the radial direction are substantially the same as the position of the insertion surface 36 in the radial direction. The opening of the above-mentioned recess 60 to the insertion surface 36 forms a plug insertion port 65 for inserting a plug 70, to be described below, into the mounting grooves 61*a*. The dimension of an interval between the plug insertion port 65 and the first chip fin 51 in the axis O direction is secured so that a first plug piece 71 and a second plug piece 72, to be described below, can be inserted into the plug insertion port 65.

As shown in FIGS. 3 and 6, the plug 70 is formed of a plurality of plug pieces, which is in this embodiment two plug pieces, that is, a first plug piece 71 and a second plug piece 72.

The first plug piece 71 is a plate-like member that has substantially the same thickness as the width of the mounting groove 61*a* in the radial direction, and is capable of closing an area of the rear side of the recess 60 in the longitudinal direction by being inserted into the mounting grooves 61*a*.

A first contact end face 71*a* of the first plug piece 71 faces the front side in the longitudinal direction and is inclined toward one side in the short direction of the recess 60 as it extends to the rear side of the recess 60 in the longitudinal direction.

An end face of the first plug piece 71 facing the rear side in the longitudinal direction is formed in a circular arc shape corresponding to the opening shape of the recess 60.

Further, similar to the first plug piece 71, the second plug piece 72 is a plate-like member that has substantially the same thickness as the width of the mounting groove 61*a* in the radial direction, and is capable of closing the area of the front side in the opening of the recess 60 in the longitudinal direction.

A second contact end face 72*a* of the second plug piece 72 faces the rear side in the longitudinal direction and is inclined toward one side in the lateral direction of the recess 60 as it extends to the rear side of the recess 60 in the longitudinal direction.

When being inserted into the mounting grooves 61*a*, the first plug piece 71 and the second plug piece 72 close the opening of the recess 60 in cooperation with each other by lining up so that the first contact end face 71*a* and the second contact end face 72*a* come into contact with each other. In this way, the opening of the recess 60 is closed by the plug 70 formed of the first plug piece 71 and the second plug piece 72, so that a cavity C which is a space isolated from the outside of the tip shroud 20 is formed in the tip shroud 20 as shown in FIG. 5.

Figure 6A:
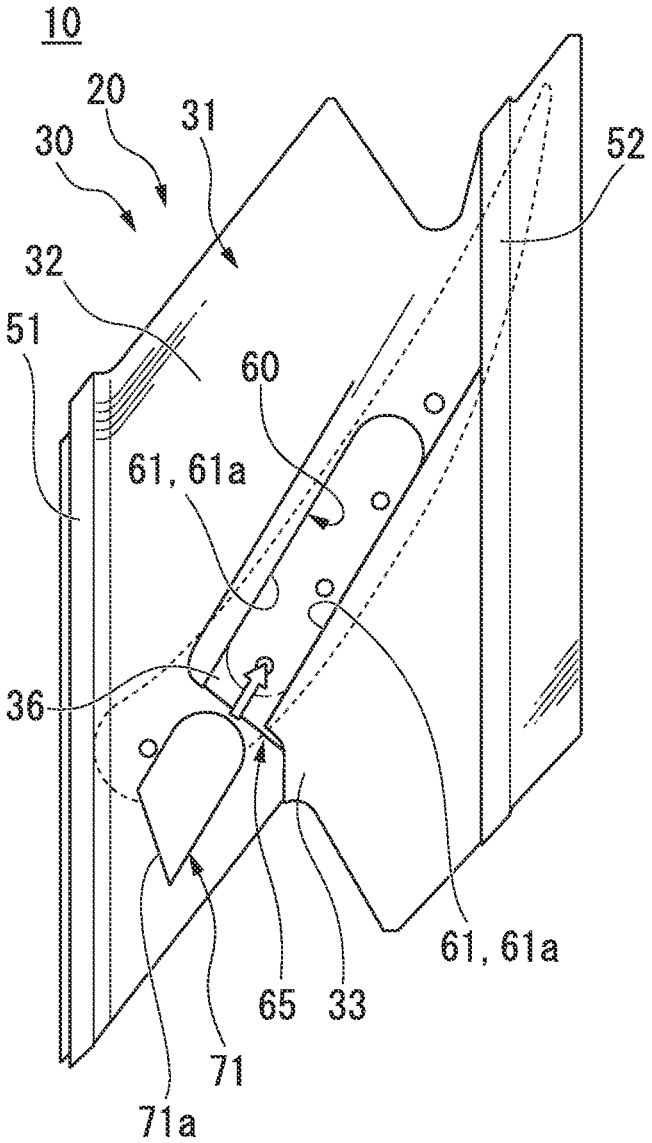
FIG. 6A is a view illustrating a procedure for inserting a plug piece into a mounting groove, and is a view showing a state immediately before a first plug piece is inserted.

When the opening of the recess 60 is closed by the plug 70, first, the first plug piece 71 is inserted from a tip side thereof, that is, the circular arc-shaped end face side into the mounting grooves 61*a* through the plug insertion port 65 as shown in FIG. 6A. Accordingly, both sides of the first plug piece 71 are fitted into the mounting grooves 61*a*, so that the radial movement of the first plug piece 71 is restricted. Further, the first plug piece 71 is slid to the rear side of the recess 60 in the longitudinal direction in this state so that the first plug piece 71 is disposed in the area on the rear side of the opening of the recess 60 in the longitudinal direction, and the tip of the first plug piece 71 comes into contact with the rear side of the recess 60 in the longitudinal direction.

Figure 6B:
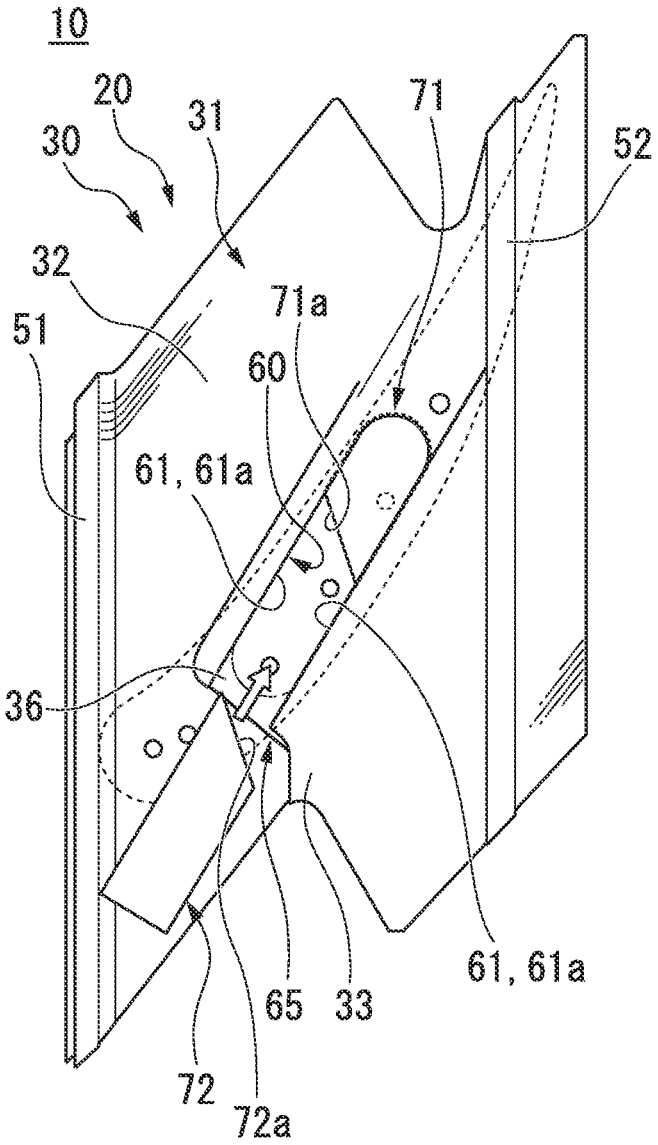
FIG. 6B is a view showing a state immediately before a second plug piece is inserted into the mounting groove after the state shown in FIG. 6A.

Subsequently, the second plug piece 72 is inserted from a tip side thereof, that is, the second contact end face 72*a* side into the mounting grooves 61*a* through the plug insertion port 65 as shown in FIG. 6B. Accordingly, both sides of the second plug piece 72 are fitted into the mounting grooves 61*a*, so that the radial movement of the first plug piece 71 is restricted. Further, the second plug piece 72 is slid to the rear side of the recess 60 in the longitudinal direction in this state so that the first plug piece 71 is disposed in the area on the front side of the opening of the recess 60 in the longitudinal direction, and the second contact end face 72*a* comes into contact with the first contact end face 71*a* of the first plug piece 71.

The first plug piece 71 and the second plug piece 72 are sequentially inserted into the mounting grooves 61*a* in this way, so that the opening of the recess 60 is closed over the entire area thereof. Accordingly, the cavity C is formed.

Cooling air is supplied to the cooling passages 14 formed in the blade body 11 from the inside in the radial direction during the operation of the gas turbine 1 that includes the gas turbine blades 10 having the above-mentioned structure. Accordingly, the blade body 11 is cooled from the inside.

Further, the cooling air having reached the outer end portions of the respective cooling passages 14 in the radial direction joins together in the cavity C formed in the tip shroud 20, and is discharged to the outside of the tip shroud 20 through the cooling holes 63. The inner surfaces of the cooling holes 63 are cooled by the cooling air at this time, so that the tip shroud 20 is cooled from the inside t hereof.

Here, a centrifugal force is generated due to the rotation of the rotor body 2 during operation of the gas turbine, and the centrifugal force is also applied to the plug 70 of the tip shroud 20. With regard to this, the plug 70 is formed of the first plug piece 71 and the second plug piece 72 and these first plug piece 71 and second plug piece 72 are inserted into the mounting grooves 61*a* so as to close the opening of the recess 60 in this embodiment. Accordingly, it is possible to reduce the deformation of the plug 70 as compared to a case where the plug 70 is formed of a single body. Therefore, it is possible to improve the durability of the plug 70 and to continue to operate the gas turbine for a long period of time.

Further, since the plug 70 is divided in this way, it is possible to easily insert the first plug piece 71 and the second plug piece 72 into the mounting grooves 61*a*, even if the first chip fin 51 and the second chip fin 52 are formed on both sides of the plug insertion port 65 in the axis O direction.

Furthermore, since the mounting grooves 61*a* are formed on the pair of side surfaces 61 of the recess 60 along the longitudinal direction in this embodiment, a direction where the pair of side surfaces 61 face each other is the lateral direction of the recess 60. Accordingly, the interval between the pair of mounting grooves 61*a* is set to be smaller than that in the case where the mounting grooves 61*a* are formed on the side surfaces of the recess 60 along the lateral direction. Therefore, since it is also possible to set the interval, which is formed between the mounting grooves 61*a* at the first and second plug pieces 71 and 72 in the direction where the pair of side surfaces face each other, to be small, it is possible to reduce the deformation of the first plug piece 71 and the second plug piece 72 caused by a centrifugal force.

That is, since it is possible to dispose the plug 70 so that the plug 70 is close to the mounting grooves 61*a* over the entire area thereof in the longitudinal direction, it is possible to inhibit the middle portion of the plug 70 from being deformed outward in the radial direction by a centrifugal force as much as possible.

Accordingly, it is possible to further reduce the swelling of the first plug piece 71 and the second plug piece 72 due to a centrifugal force.

Further, in this embodiment, the longitudinal direction of the recess 60 extends in the direction that is inclined from the axis O direction. Accordingly, even if the chip fins are formed on both sides of the plug insertion port 65 of the recess 60 in the axis O direction, it is possible to easily insert the first plug piece 71 and the second plug piece 72 into the mounting grooves 61*a* without interference from the chip fins.

Furthermore, since the longitudinal direction of the recess 60 extends in the direction inclined from the circumferential direction, it is possible to prevent the first plug piece 71 and the second plug piece 72 from coming off the mounting grooves 61*a* by the rotational acceleration of the rotor body 2 in the circumferential direction and exposing the recess 60.

Moreover, in this embodiment, the plug insertion port 65 is formed on the front side in the longitudinal direction of the recess 60 which includes the mounting grooves 61*a* formed on the side surfaces 61, and the insertion surface 36 of which the position is substantially the same as the position of the mounting groove 61*a* in the radial direction is formed at the plug insertion port 65. Accordingly, it is possible to easily guide the first plug piece 71 and the second plug piece 72 to the mounting grooves 61*a*. Accordingly, it is possible to easily and reliably insert the first plug piece 71 and the second plug piece 72 into the mounting grooves 61*a*.

The embodiment of the present invention has been described in detail above, but the invention is not limited to the embodiment and may be somewhat modified in design without departing from the scope of the invention.

Figure 7:
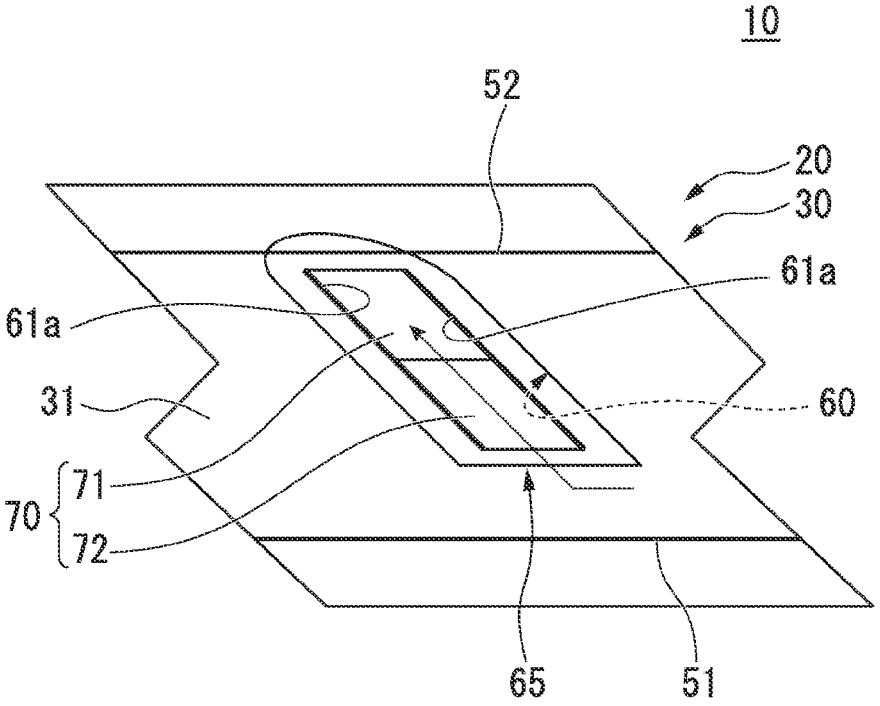
FIG. 7 is a view of a turbine blade according to a first modification when seen from the outside in the radial direction of the rotor.

For example, in the embodiment, the outer peripheral end face 31 of the shroud body 30 includes the first main surface 32 and the second main surface 33. However, for example, a recess 60 may be formed on a smooth outer peripheral end face 31 as in a modification shown in a schematic view of FIG. 7.

That is, in this modification, an area of the outer peripheral end face 31 between the first chip fin 51 and the second chip fin 52 is formed in a shape of a smoothly curved outer peripheral surface and the recess 60 is formed so as to be dented outward from the outer peripheral end face 31 in the radial direction. Further, as in the embodiment, the opening of the recess 60 is closed by the plug 70 that is formed of the first plug piece 71 and the second plug piece 72 to be inserted into the mounting grooves 61*a*. Even according to this, since the plug 70 is divided into the first plug piece 71 and the second plug piece 72 as in the embodiment, it is possible to reduce the swelling of the plug 70 due to a centrifugal force as well as to easily insert the plug 70 into the mounting grooves 61*a*.

Figure 8:
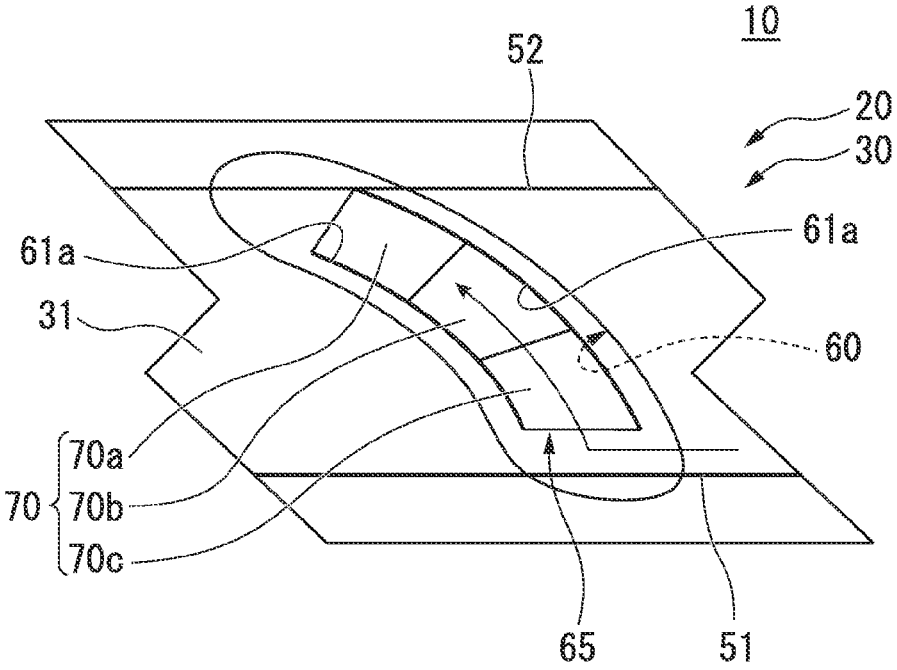
FIG. 8 is a view of a turbine blade according to a second modification when seen from the outside in the radial direction of the rotor.

Furthermore, the plug 70 has been formed of the first plug piece 71 and the second plug piece 72 in the embodiment. However, a plug 70 may be formed of three plug pieces 70*a*, 70*b*, and 70*c* as a second modification shown in FIG. 8. In this case, the size of each of the plug pieces 70*a*, 70*b*, and 70*c* is smaller than that of the plug piece of the plug 70 that is divided into two plug pieces. Accordingly, it is possible to further reduce swelling caused by a centrifugal force and to easily insert the plug pieces into the mounting grooves 61*a*. The plug 70 may be divided into four or more plug pieces. Moreover, the mounting grooves 61*a* have been formed in a linear shape in the embodiment, but the mounting grooves 61*a* may be formed in a curved shape as shown in the second modification.

Figure 9:
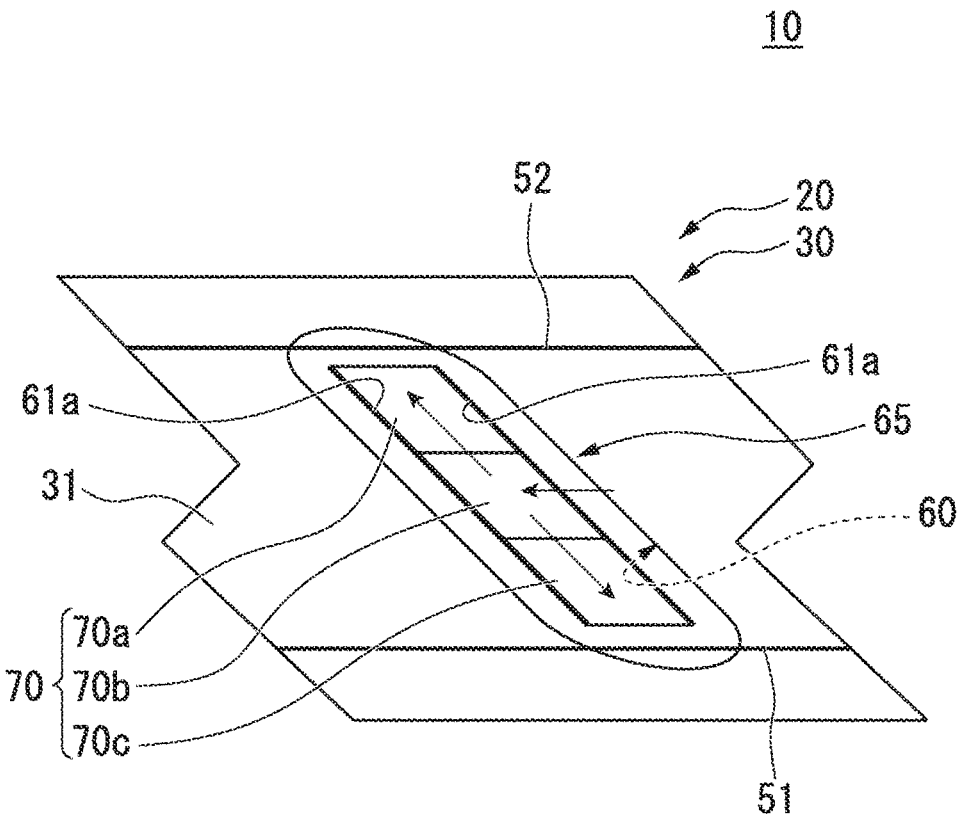
FIG. 9 is a view of a turbine blade according to a third modification when seen from the outside in the radial direction of the rotor.

In a third modification, for example, as shown in FIG. 9, the plug insertion port 65 which is opened to the other side in the circumferential direction may be formed at the middle portion in the longitudinal direction of one of the pair of side surfaces 61 of a the recess 60 along the longitudinal direction, and the first plug piece 71 and the second plug piece 72 may be inserted into the mounting grooves 61*a* from the plug insertion port 65. In this third modification, the plug pieces

70*a* and 70*c* inserted from the plug insertion port 65 are moved along the mounting grooves 61*a* to the front side and the rear side, respectively, in the longitudinal direction. After that, another plug piece 70*b* is inserted into the plug insertion port 65, so that the opening of the recess 60 is closed by total three plug pieces 70*a*, 70*b*, and 70*c*. Accordingly, it is possible to reduce the swelling of the plug 70 caused by a centrifugal force, so that it is possible to easily insert the plug 70 into the mounting grooves.

Further, cooling has been performed using air in the embodiment. However, an object used for cooling is not limited to air and, for example, steam may be used. That is, the plurality of cooling passages 14 are formed in the turbine blade 10, and steam is flown into a part of the plurality of cooling passages 14 from the blade root toward the outside in the radial direction of the rotor body 2, and the steam is recovered in a cavity C formed by the plug 70 and the recess 60 provided on the tip shroud 20. After that, the recovered steam is flown toward the inside in the radial direction of the rotor body 2 through the others of the plurality of cooling passages 14, and recovered on the blade root side. According to this structure, it is possible to improve the durability of the plug 70 in the turbine blade 10 using a cooling medium such as steam that needs to be recovered.

INDUSTRIAL APPLICABILITY

The present invention relates to a turbine blade including a blade body that is mounted on a rotor body so as to extend outward from the rotor body in a radial direction of the rotor body, and a tip shroud that is fixed to the outside of the blade body in the radial direction. Cooling passages which extend in the radial direction of the rotor body and in which a cooling medium circulates are formed in the blade body. The tip shroud includes a shroud body where a recess opened to the outside in the radial direction and communicating with the cooling passages is formed on an outer peripheral end face, and a plug that includes a plurality of plug pieces closing an opening of the recess in cooperation with each other by being inserted into mounting grooves formed on side surfaces of the recess. According to the present invention, since the plug is divided into the respective plug pieces, it is possible to reduce swelling due to a centrifugal force. Accordingly, it is possible to improve the durability of the plug.

DESCRIPTION OF REFERENCE NUMERALS AND SIGNS

1: gas turbine
2: rotor body
5: turbine
5*a*: turbine casing
10: turbine blade
11: blade body
14: cooling passage
20: t shroud
30: shroud body
31: outer peripheral end face
51: first chip fin (chip fin)
52: second chip fin (chip fin)
60: recess
61: side surface
61*a*: mounting groove
62: bottom
65: plug insertion port
70: plug
70*a*: plug piece
70*b*: plug piece
70*c*: plug piece
71: first plug piece (plug piece)
71*a*: first contact end face
72: second plug piece (plug piece)
72*a*: second contact end face
C: cavity

The invention claimed is:

1. A turbine blade comprising:

a blade body that is mounted on a rotor body so as to extend outwards from the rotor body in a radial direction of the rotor body; and a tip shroud that is fixed to an outside of the blade body in the radial direction, wherein a cooling passage which extends in the radial direction of the rotor body and in which a cooling medium circulates is formed in the blade body, and the tip shroud includes a shroud body wherein a recess opened to the outside in the radial direction and communicating with the cooling passage is formed on an outer peripheral end face;

a plug that includes a plurality of plug pieces closing an opening of the recess in cooperation with each other by being inserted into mounting grooves formed on side surfaces of the recess;

an insertion surface formed at a plug insertion port for inserting the plug pieces into the mounting grooves and of which the position is substantially the same as that of the mounting grooves in the radial direction; and a first main surface formed on the outer peripheral end face so as to be recessed inwards in the radial direction with respect to the insertion surface, wherein at least one portion of the mounting grooves is positioned so as to separate outwards from the first main surface in the radial direction.

2. The turbine blade according to claim 1, further comprising:

a second main surface formed on the outer peripheral end face so as to be raised outwards in the radial direction with respect to the first main surface.

3. The turbine blade according to claim 1, wherein the plug insertion port is formed on the shroud body so as to be positioned on at least one end side of the recess extending in the longitudinal direction.

4. The turbine blade according to claim 1, wherein the shroud body includes a plurality of t fins that protrude from the outer peripheral end face, extend in a circumferential direction of the rotor body, and are disposed at intervals in the axial direction of the rotor body, and the recess is formed between the plurality of tip fins.

5. A gas turbine comprising:

a rotor body; and a casing that rotatably covers the rotor body, wherein the turbine blades according to claim 1 are mounted on the rotor body.

6. The gas turbine according to claim 5, wherein the recess extends in a direction along the outer peripheral end face as a longitudinal direction thereof, the mounting grooves are formed on the pair of side surfaces along the longitudinal direction, and the plurality of plug pieces close the opening of the recess by lining up in the longitudinal direction so as to come into contact with each other.

7. The gas turbine according to claim 6, wherein a plurality of the cooling passages are formed in the blade body, outer end portions of the plurality of cooling passages in the radial direction are arranged in a direction that is inclined in a circumferential direction of the rotor body and an axial direction of the rotor body, and the recess extends in an arrangement direction of the outer end portions of the plurality of cooling passages in the radial direction as the longitudinal direction thereof.

8. The gas turbine according to claim 5, wherein the plug insertion port is formed on the shroud body so as to be positioned on at least one end side of the recess extending in the longitudinal direction.

9. The gas turbine according to claim 5, wherein the shroud body includes a plurality of tip fins that protrude from the outer peripheral end face, extend in the circumferential direction of the rotor body, and are disposed at intervals in the axial direction of the rotor body, and the recess is formed between the plurality of tip fins.

* * * * *